United States Patent [19]

Pennybaker

[11] 4,257,597

[45] Mar. 24, 1981

[54] BOWLING ARM TRAINING DEVICE

[76] Inventor: Richard W. Pennybaker, 122 Alsup La., Lavergne, Tenn. 37086

[21] Appl. No.: 60,203

[22] Filed: Jul. 24, 1979

[51] Int. Cl.[3] ..... A63B 69/00

[52] U.S. Cl. ..... 273/54 B; 273/183 B

[58] Field of Search ..... 273/54 B, 183 B, 189 R

[56] References Cited

U.S. PATENT DOCUMENTS

| | | | |
|---|---|---|---|
| 2,773,691 | 12/1956 | Redfield | 273/189 R |
| 3,000,633 | 9/1961 | Bonovich | 273/54 B |
| 3,469,841 | 9/1969 | McKee | 273/54 B |
| 3,774,572 | 11/1973 | Borraccio | 273/183 B X |

*Primary Examiner*—Anton O. Oechsle

*Attorney, Agent, or Firm*—Harrington A. Lackey

[57] ABSTRACT

A bowling arm training device including a cuff or support member adapted to be detachably secured about the bowling arm of the bowler, a yieldable elastic trigger member mounted on the cuff to extend circumferentially around the inside of the cuff member and terminating in a free rear end portion cooperative with a signal device, whereby when the bowling arm swings forward in its correct delivery position close to the body of the bowler, the elastic trigger member engages the bowler's body abruptly forcing the trigger member laterally outward actuating the signal device to apprise the bowler of his correct delivery swing. If the bowling arm swings too far away from the body of the bowler, the signal device will not be actuated, thereby apprising the bowler of an incorrect delivery.

4 Claims, 6 Drawing Figures

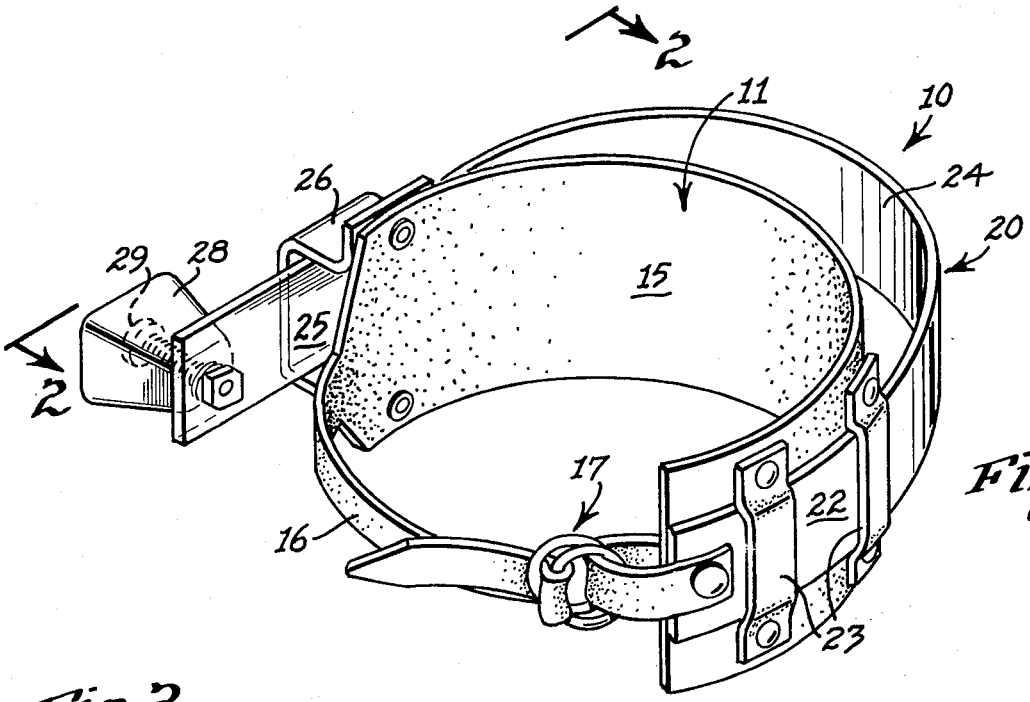
Fig. 1
Fig. 2
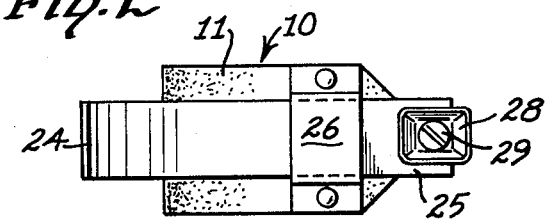
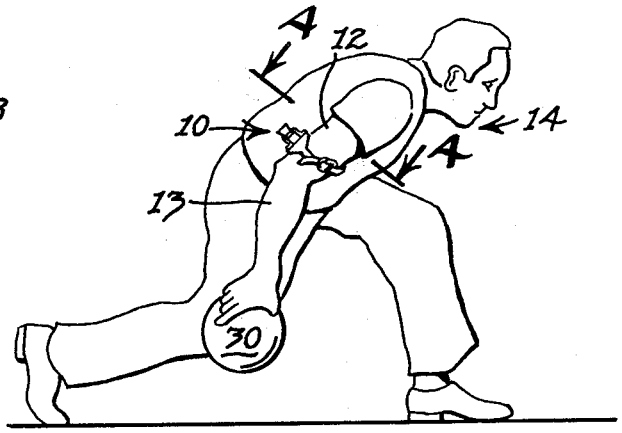
Fig. 3
Fig. 4
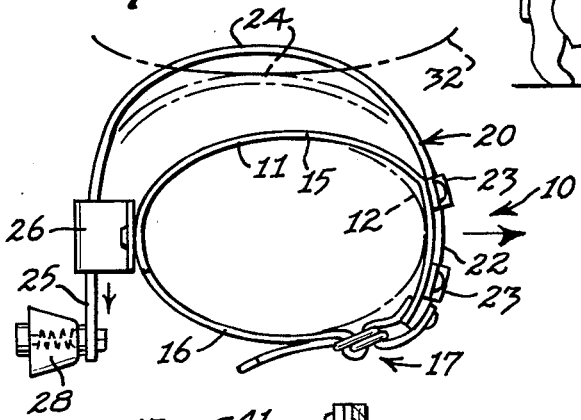
Fig. 5
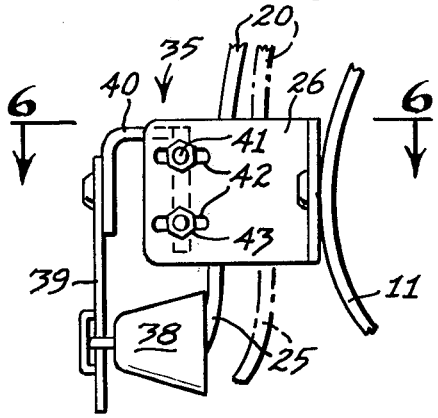
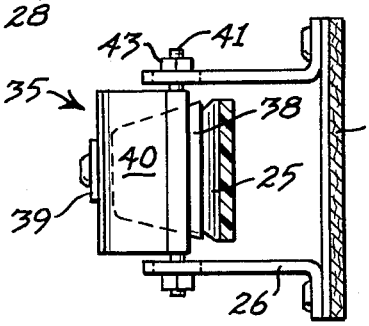
Fig. 6

BOWLING ARM TRAINING DEVICE

BACKGROUND OF THE INVENTION

This invention relates to a bowling training device, and more particularly to a bowling arm training device.

When a bowler correctly delivers a bowling ball down the bowling alley, his bowling or delivery arm must swing close to the side of his body in order to maintain optimum control of the delivery and direction of the bowling ball.

In order for a bowler to learn how to deliver with the correct swing, he must be overly conscious of the position of his arm as it swings for the delivery. Sometimes he may be apprised of the correct delivery swing by being conscious of the sleeve of his shirt passing in contact with the side of his body or the body portion of his shirt. Heretofore, the bowler may also be apprised of the correct arm swing for delivery by having an instructor, or fellow bowler, observe the position of his arm as he swings.

However, these methods of determining correct arm delivery positions are dependent upon the type of clothing the bowler wears in the first instance, and the presence of an instructor or another bowler, in the second instance.

SUMMARY OF THE INVENTION

It is therefore an object of this invention to provide a bowling arm training device capable of being detachably secured to the bowler's bowling arm, preferably the upper arm. This training device is provided with a yieldable trigger member and a cooperative signal device, such as a bell, whereby when the bowling arm swings in its correct position close to the body of the bowler, the signal device will be activated to consistently apprise the bowler that his delivery swing is correct.

More specifically, this bowling arm training device includes a cuff or arm support member adapted to be secured by buckle, or other detachable fastening device, about the upper arm of the bowler's bowling arm. When properly secured to the bowler's upper arm, the body contact portion of the yieldable trigger member is disposed on the inside of the bowling arm opposite the side of the bowler. As the bowler swings his bowling arm forward in its true and correct delivery position, the bowling arm will pass close enough to the side of the bowler's body to cause the trigger member to engage and be forced outward by, the side of the bowler's body. Either the abruptness of this outward movement of the trigger member, or its inward return movement after contact with the bowler's body, will actuate the signal device, such as a bell, to automatically apprise the bowler that his delivery swing was true and correct.

If the bowler's bowling arm is swinging too wide of his body, then the signal device will not be actuated. Thus, the silence of the device apprises the bowler of his incorrect delivery swing.

BRIEF DESCRIPTION OF THE DRAWINGS

FIG. 1 is a top front outside perspective view of a bowling arm training device made in accordance with this invention;

FIG. 2 is a rear elevation of the training device taken along the line 2—2 of FIG. 1;

FIG. 3 is a side elevation of a bowler upon whose arm the training device disclosed in FIG. 1 is mounted;

FIG. 4 is a top plan view of the training device as viewed along the line 4—4 of FIG. 3, showing the trigger member in its solid-line inoperative position, and in its dashed-line operative position engaging the side of the bowler's body illustrated in phantom;

FIG. 5 is a fragmentary top plan view of a modified form of signal device; and FIG. 6 is a section taken along the line 6—6 of FIG. 5.

DESCRIPTION OF THE PREFERRED EMBODIMENTS

Referring now to the drawings in more detail, FIGS. 1–4 disclose a preferred embodiment of the bowling arm training device 10 made in accordance with this invention.

The training device 10 includes a support member, such as the cuff 11, made of flexible leather or plastic, adapted to fit around the upper arm 12 of the bowling arm 13 of the bowler 14 (FIG. 3). As disclosed in FIGS. 1 and 2, the cuff 11 includes a wide flexible strap portion 15 and a narrow strap portion 16 adapted to be detachably secured to one end of the wide strap portion 15 by a buckle mechanism 17 of any desired design.

A trigger member 20 in the form of a yieldable elastic strap member has its front end portion 22 secured to the front end portion of the cuff 11 by cross straps 23 bradded to the strap portion 15.

The elastic strap member 20 curves about the inside surface of the cuff 11, spaced inward therefrom, to provide a depressable or yieldable body contact portion 24. The rear end portion 25 of the elastic strap member 20 is extended through a loop guide or retainer member 26 fixed to the rear portion of the cuff 11. The loop guide 26 forms a large enough opening for freely receiving the rear end portion 25 for free circumferential movement of the strap member 20 relative to the cuff 11, but limits the radial outward movement of the rear end portion 25 relative to the cuff 11. Accordingly, the radial inward movement of the body contact portion 24 is limited to hold the strap member 20 in the circumferential spaced position relative to the cuff 11, as illustrated in FIGS. 1 and 4.

In the device 10, as disclosed in FIGS. 1–4, a signal device in the form of an audible signal device, such as the bell 28, is secured to the rear end portion 25 of the strap member 20. The clapper 29 of the bell 28 is yieldably supported within the housing of the bell 28. Thus, any abrupt or forceful outward movement of the trigger member 20 toward the cuff 11 will jar the bell 28 to cause it to ring. Also, the return movement of the free end portion 25 radially outward to abruptly or forceably engage the retainer member 26 will also cause the bell 28 to ring.

With the cuff 11 secured about the upper arm 12 of the bowler 14, as disclosed in FIG. 3, when the bowler swings his bowling arm 13 from a rearward toward a forward delivery position, the bell 28 will be caused to ring as the arm 13 moves past, and in close proximity to, the side of the bowler 14. As the bowling arm 13 moves past the side of the bowler 14, such as in an intermediate position disclosed in FIG. 3, the body contact portion 24 of the elastic strap member 20 will abruptly engage the side of the bowler forcing the strap member 20 rapidly outward from the body toward the cuff 11, thereby causing actuation of the bell 28. The sound of the bell 28 will apprise the bowler 14 that the swinging of his bowling arm 13 is in its true and correct position for delivery of the bowling ball 30.

After the bowling arm 13 has moved forward past the side of the bowler 14, the trigger member 20, by virtue of its elasticity, will be restored to its normal inoperative position disclosed in FIGS. 1 and 4. However, in moving toward its restored position, the free rear end portion 25 of the trigger member 20 will abruptly engage the retainer member 26, to again jog the bell 28 and cause it to ring.

FIG. 4 illustrates the actuation of the bell 28 by the engagement of the body contact portion 24 of the trigger member 20 with the side 32 of the bowler 14. The body contact portion 24 is disclosed in its normal inoperative solid-line position, while it is shown in its operative phantom-line position engaging the body 32 of the bowler 14.

In the event that the bowling arm 13 is swung laterally too far from the side of the bowler 14, then no contact will be made between the trigger member 20 and the side of the bowler. Thus, the silence of the bell 28 will apprise the bowler 14 that his delivery swing was incorrect.

FIGS. 5 and 6 disclose a modified signal device in which the bell 38 is mounted upon a flexible arm 39 which is secured to a bracket 40 having bolts 41 projecting laterally out through radially elongated slots 42. Adjustable nuts 43 on the bolts 41 permit radial adjustment of the bell 38 relative to the free rear end portion 25 of the elastic strap member 20. The slots 42 are formed in the side walls of the guide or retainer member 26 fixed to the cuff 11.

Thus, when the elastic strap member 20 is abruptly moved by engagement with the side of the body of the bowler 14, the free end portion 25 moves the bell 38, when the free end portion 25 is moving toward or away from the bell 38, as illustrated in the solid-line and the dashed-line positions of the trigger member 20 in FIG. 5.

By using the device 10 or 35, the bowler 14 will be consistently apprised of the correctness of his delivery swing with the bowling arm 13. When his swing is correct, and he is apprised of such a correct position by the ringing of the bell 28 or 38, he will have better control over the delivery and the direction of the bowling ball 30, which should materially improve his score.

By habitually training with the training device 10 or 35, the correct bowling swing will become automatic, so that the wide swing or the "cross-over" swing will be gradually eliminated, and the bowler's posture, performance, and score will materially improve. The bowler learns with the training devices 10 or 35 to use the side of his body 32 as a guide in the delivery swing of his bowling arm.

What is claimed is:

1. A sports training guide device comprising:

(a) a support member adapted to be detachably secured to the limb of a sports trainee, said support member having an inside portion and front and rear portions, (b) a trigger member comprising a longitudinally curved elastic strap member having a front end fixedly mounted on the front end portion of said support member, and having a body contact portion normally disposed on the inside of the limb, extending around and spaced inward from said inside portion, and movable laterally outward toward the limb upon being engaged by an opposed body portion of the trainee during correct movement of the limb relative to the opposed body portion, (c) a signal device cooperative with said trigger member, (d) said elastic strap member terminating in a free rear end portion in cooperative relationship with said signal device for actuation of said signal device when said body contact portion is moved laterally outward.

2. The invention according to claim 1 further comprising a retainer member fixed to the rear portion of said support member and receiving said strap member for free circumferential movement but limiting the inward movement of said strap member.

3. The invention according to claim 2 in which said signal device comprises a bell mounted on the free end portion of said strap member, said bell being actuated by the abrupt movement of said strap member.

4. The invention according to claim 2 in which said signal device comprises a bell mounted on said retainer member, said bell being actuated by the movement of the free end portion of said strap member striking said bell.

* * * * *